US006143994A

United States Patent [19]

Thivilier

[11] Patent Number: 6,143,994

[45] Date of Patent: Nov. 7, 2000

[54] ELECTRICAL SWITCH FOR AN AUTOMOBILE ANTI-THEFT DEVICE

[75] Inventor: Franck Thivilier, Castelldefels, Spain

[73] Assignee: Valeo Securite Habitacle, Creteil, France

[21] Appl. No.: 09/502,320

[22] Filed: Feb. 11, 2000

[30] Foreign Application Priority Data

Feb. 12, 1999 [FR] France ..... 99 01686

[51] Int. Cl.[7] ..... H01H 21/82

[52] U.S. Cl. ..... 200/11 R; 200/43.03; 200/569; 200/242

[58] Field of Search ..... 200/11 R–11 K, 200/43.01, 43.03, 43.04, 43.08, 564, 568, 569, 572, 239, 241, 242, 336

[56] References Cited

U.S. PATENT DOCUMENTS 3,497,643 2/1970 Heath ..... 200/6
4,803,313 2/1989 Rolf ..... 200/6 BB
5,568,860 10/1996 Stringwell et al. ..... 200/242
5,865,304 2/1999 Barnard et al. ..... 200/569

FOREIGN PATENT DOCUMENTS 2 763 421 11/1998 France ..... H01H 21/50
29 37 925 6/1981 Germany ..... H01H 19/62

OTHER PUBLICATIONS

French Search Report dated Oct. 14, 1999.

*Primary Examiner*—Michael Friedhofer
*Attorney, Agent, or Firm*—Morgan & Finnegan LLP

[57] ABSTRACT

A rotary electrical switch for an automobile vehicle anti-theft device of the type comprising a rotor mounted free to rotate about a stator to supply electrical power to a starter, by at least one electrical strip contact, wherein the rotor comprises a surface acting as a cam to clean the electrical contact that cooperates with a portion facing the intermediate segment of a contact strip to elastically deform the contact strip globally in its median axial plane, causing relative displacement of the free lower end of the mobile segment with respect to the contact portion of the fixed contact element with which it is in contact, when the rotor closes or opens the electrical contact.

9 Claims, 4 Drawing Sheets

ELECTRICAL SWITCH FOR AN AUTOMOBILE ANTI-THEFT DEVICE

BACKGROUND OF THE INVENTION

This invention relates to an electrical switch.

The invention more particularly relates to a rotary electrical switch for an automobile vehicle anti-theft device, of the type comprising a rotor body that is mounted free to rotate about its center line with respect to a stator body, and of the type in which the rotor body is free to rotate between two angular positions, particularly between a neutral angular position and a start angular position in which it supplies an electrical power supply to equipment, particularly to an electrical starter for a thermal combustion engine, for example passing through an intermediate position.

In an automobile vehicle anti-theft device, the switch rotor is driven in rotation, for example by a key or by a part fixed to a lock cylinder rotor that is itself activated using the right key.

When the lock cylinder is unlocked, the switch rotor can be rotated from a "stop" position in which most electrical circuits in the vehicle are isolated from the battery power supply. There are usually three other positions, namely "accessories", "on" and "start" in which the switch provides an electrical power supply to the different circuits and devices in the vehicle.

In particular, the "on" position provides an electrical power supply to the ignition circuit of the thermal combustion engine in the vehicle, without which the thermal combustion engine cannot run.

In a known manner, the "start" position applies electrical power to an electrical starter motor that is designed to rotate the crankshaft of the vehicle thermal combustion engine, in order to start the thermal combustion engine.

BRIEF SUMMARY OF THE INVENTION

The starter is powered by means of at least one electrical strip contact comprising a fixed axially aligned contact element supported by the stator and a hairpin shaped contact strip that lies within an axial plane that comprises a fixed axially aligned segment supported by the stator and a mobile axially aligned segment approximately parallel to the first fixed segment and connected to it through an upper intermediate segment in the shape of an arc of a circle, the lower free end of the mobile segment being capable of cooperating or not cooperating with a contact portion of the fixed contact element facing it, depending on the relative angular position of the rotor and the stator.

An example of this type of switch with electrical strip contacts is described and shown in document FR-A-2.763.421.

Therefore, the purpose of the invention is to propose a switch of the type mentioned above for an automobile vehicle that prevents the electrical strip contacts from becoming dirty by performing a self-cleaning action on the contacts.

Consequently, the invention proposes a rotary electrical switch for an automobile vehicle anti-theft device of the type comprising an upper rotor mounted free to rotate about its axis with respect to a lower stator, and of the type in which the rotor is capable of rotating between two angular positions, in particular a neutral angular position and a start angular position in which it enables the electrical power supply to an equipment, and particularly an electrical starter for a thermal combustion engine, by means of at least one electrical strip contact comprising a fixed axially aligned contact element supported by the stator and a hairpin shaped contact strip that lies within an axial plane and that comprises a fixed axially aligned segment and a mobile axially aligned segment that is approximately parallel to the first fixed segment and that it is connected to it through an upper intermediate segment in the shape of an arc of a circle, the lower free end of the mobile segment being capable of cooperating or not cooperating with a contact portion facing the fixed contact element depending on the relative angular position of the rotor and the stator, characterized in that the rotor comprises a surface acting as a cam to clean the electrical contact that cooperates with a portion facing the intermediate segment of the contact strip to elastically deform the contact strip, globally in its median axial plane, causing relative displacement of the free lower end of the mobile segment with respect to the contact portion of the fixed contact element with which it is in contact, when the rotor closes or opens the electrical contact.

According to other characteristics of the invention:

- the surface of the contact cleaning cam is formed inside a cylindrical annular skirt with the same axial alignment as the rotor that cooperates with the radially external portion of the intermediate curved segment of the mobile contact strip facing it, in order to cause relative vertical displacement of the lower free end of the mobile segment with respect to the contact portion of the fixed contact element;
- the surface of the cleaning cam comprises an active angular sector of revolution that cooperates with the intermediate curved segment of the contact strip when the electrical contact is open;
- the active sector of the surface of the cleaning cam extends angularly so as to cooperate with the intermediate curved segment of the contact strip during the final part of the angular travel of the rotor that closes the electrical contact, or during the initial part of the angular travel of the rotor that opens the electrical contact;
- the profile of the active sector of the surface of the cleaning cam is tapered;
- the angular active sector of the surface of the cleaning cam is delimited by two recesses formed in the rotor skirt;
- the mobile segment of the contact strip comprises a control surface on which the rotor can act to elastically push the mobile segment of the contact strip radially outwards to open the electrical contact which is of the normally closed type, resisting the inherent elasticity of the contact strip;
- the control surface is convex and faces radially inwards, and cooperates with a surface of the rotor control cam;
- the profile of the intermediate curved segment of the contact strip that cooperates with the surface of the cleaning cam is non-aggressive to the cam surface.

BRIEF DESCRIPTION OF THE DRAWINGS

Other characteristics and advantages of the invention will become clear after reading the detailed description below, which will be more easily understood with reference to the attached drawings in which.

DETAILED DESCRIPTION OF THE INVENTION

In the following description, the terms "vertical", "horizontal", "upper", "lower", etc., will be used non-restrictively and particularly with reference to the figures, in order to facilitate understanding of the description and the claims.

Figure 1:
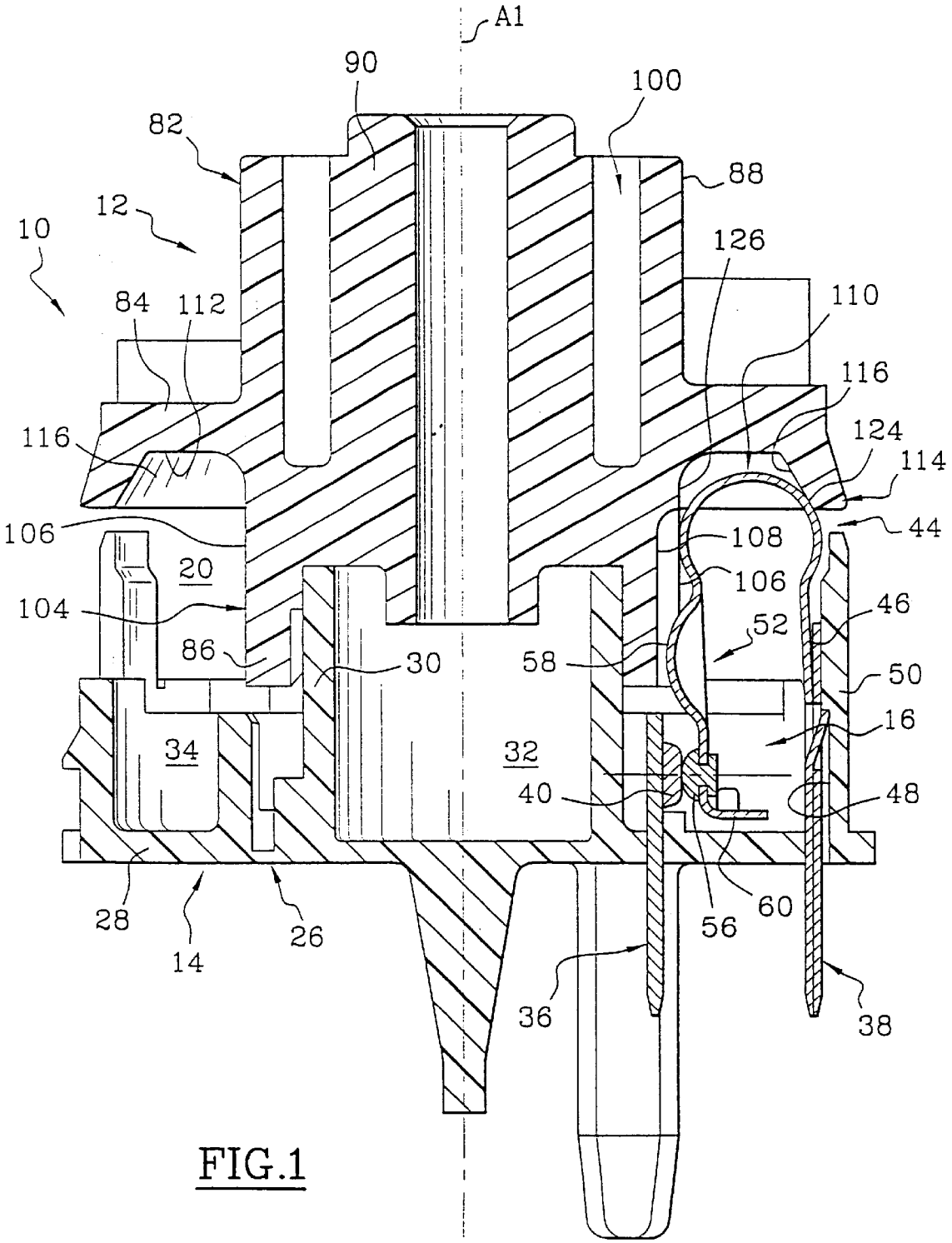
FIG. 1 is a diagrammatic view of an axial section through some components of a switch according to the invention in which the rotor is in an angular position in which an electrical strip contact is in the closed position and is cleaned.

FIG. 1 shows some components belonging to a rotary switch 10 with a vertical axis A1 designed to be used on an anti-theft device for an automobile vehicle (not shown). For example, it is assumed that the anti-theft device comprises a rotary lock cylinder that is laid out axially above switch 10 and that can be unlocked and driven in rotation by the appropriate key.

The switch 10 comprises essentially a rotor body 12 that is mounted in rotation in a stator body 14 and that is capable of acting on a series of contacts 16 of the strip type laid out in an annular cylindrical internal chamber 20 inside the switch 10, to selectively control the electrical power supply to a number of electrical circuits in the vehicle depending on the angular position of the body of rotor 12 around its center line A1.

For example, the body of rotor 12 may occupy four preferred angular positions with respect to the stator 14, namely the "stop", "accessories", "on" and "start" positions, in order.

The body of stator 14 of switch 10 comprises a cylindrical housing (not shown) with center line A1.

The body of stator 14 is axially delimited near the bottom by a lower end 26 that forms an external transverse wall 28 from which a tubular wall 30 extends inwards towards the body of stator 14. The annular wall 30 thus delimits a central cylindrical confinement 32 and a peripheral annular confinement 34 that both open axially into chamber 20 at the top end.

For example, the lower end 26 may comprise five strip contacts 16 that are laid out in the peripheral annular confinement 34, each comprising two pins 36, 38 that extend axially downwards outside the body of stator 14, through the transverse wall 28 at the lower end 26, to connect the switch 10 to vehicle electrical circuits that may be open or closed depending on the angular position of the body of rotor 12 in the body of stator 14.

Each strip contact 16 comprises a fixed contactor 40 laid out on an external cylindrical surface 42 of the annular wall 30 of the end 26 that faces radially outwards, and that is fixed to a first 36 of the connection pins of the strip contact 16.

Each contact 16 also comprises a hairpin shaped strip 44 that comprises a first approximately fixed segment 46 installed along the center line of the second 38 of the connection pins in the upwards direction.

The first peripheral segment 46 is fixed to the internal surface 48 of an external annular wall 50 of the end 26 that extends vertically upwards from the upper face of the wall 28 and that radially delimits the outside of the annular containment 34.

The first peripheral segment 46 is prolonged by a radially internal segment 52 that is curved radially inwards and that extends axially downwards parallel to the segment 46 extending into the external peripheral containment 34. The second segment 52 of the strip 44 is fitted with a contact part 56 facing radially inwards, opposite the fixed contactor 40, at the free lower end 54.

Figure 3:
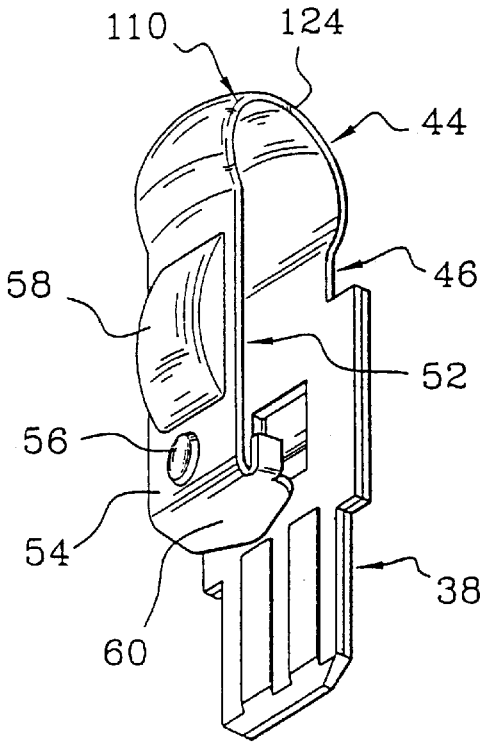
FIG. 3 is a perspective view of the contact strip illustrated in FIG. 2 from a different angle.

As can be seen particularly in FIG. 3, the second segment 52 of strip 44 comprises a convex control surface 58 that faces radially inwards and on which the body of rotor 12 is capable of acting to elastically push the second segment 52 of strip 44 radially outwards in order to separate the contact part 56 of the associated contactor 40 in order to open an electrical circuit which, in the free state of strip 44, is closed by the elastic action of strip 44 that pushes contact 56 against contactor 40.

Furthermore, the free end 54 of the strip 44 on which contactor 56 is fitted comprises a transverse rim 60 that faces radially outwards and that can come into contact with an internal surface of the first segment 46 of the strip 44 in order to limit the movement of the second segment 52 radially outwards when the body of rotor 12 acts so as to radially separate it outwards, as will be described below.

Thus, the lower end 26 can be fitted with a key presence contact (not shown).

The body of the rotor 12 of switch 10 according to the invention comprises essentially an upper axial segment 82 driving the body of rotor 12, an external radial collar 84 laid out to be axially centered, and a tubular lower axial segment 86 designed to control the strip contacts 16.

The upper axial segment 82 comprises an external tubular cylindrical wall 88 that fits in rotation into a housing not shown and a central cylinder 90 that extends axially to cooperate with a drive part (not shown) connected to the anti-theft device and capable of rotating with the key.

An annular axial housing 100 that is open axially upwards is thus radially delimited between the cylinder 90 and the external cylindrical wall 88, and it contains a spiral spring with an angular action (not shown) that is designed to elastically return the body of rotor 12 from its angular "start" position to its angular "on" position, in a known manner.

The lower axial segment 86 of the body of rotor 12 comprises a tubular wall that extends axially downwards, and is cylindrical, but is not a cylinder of revolution. The wall thus delimits an external surface 104 that forms a cam surface, in which the distance with respect to center line A1 is variable about this axis.

The wall is thus capable of cooperating with the control surfaces 58 of each strip contact 16 to make or break the circulation of electrical current in the circuits associated with each of these contacts 16, depending on whether a convex surface 58 cooperates with the cylindrical part of revolution 106 of the external surface 104, or with an internal radial recess 108 formed in the external surface 104.

The switch 10 can thus comprise means (not shown in detail) for indexing the angular position of the body of rotor 12 with respect to the body of stator 14, and non-return means that in some cases limit the possibility for the body of rotor 12 from pivoting from one of its positions to another, for example when the body of rotor 12 was previously brought to its start position and is currently being moved to one of its other three positions ("on", "accessories", or "stop").

When the body of rotor 12 has reached at least one intermediate angular position, the non-return means prevent the rotor body 12 from moving once again to its "start" position without first having passed through a neutral position, for example the "accessories" or "stop" position.

According to the terms of the invention, each electrical contact 16 has two elements 36 and 44 and is designed to cooperate with the body of rotor 12 to be self-cleaning.

Consequently, the body of rotor 12 cooperates with the intermediate segment 110 of each contact strip 44 that connects the fixed axially aligned segment 46 and the mobile axially aligned segment 52.

According to one known design, each intermediate connecting segment 110 has a profile in the shape of the arc of a cylinder, in other words a profile in the arc of a circle when considering a section through an axial plane (as shown on FIG. 1 and in FIGS. 5 to 8). Each contact 16, and more particularly its contact strip 44, extends in a vertical and axial plane with its intermediate curved connecting segment 110 located axially in the upper part and laid out facing the lower face 112 of the outer radial collar 84 of the body of rotor 12.

In order to act on the intermediate curved connecting segment 110, the body of rotor 12 comprises a generally tapered annular skirt 114 that extends axially downwards from the periphery of the external radial collar 84.

The skirt 114 thus delimits a radially internal surface 116 that, according to the invention, forms a surface or path for the cam that cleans the electrical contacts 16.

Figure 2:
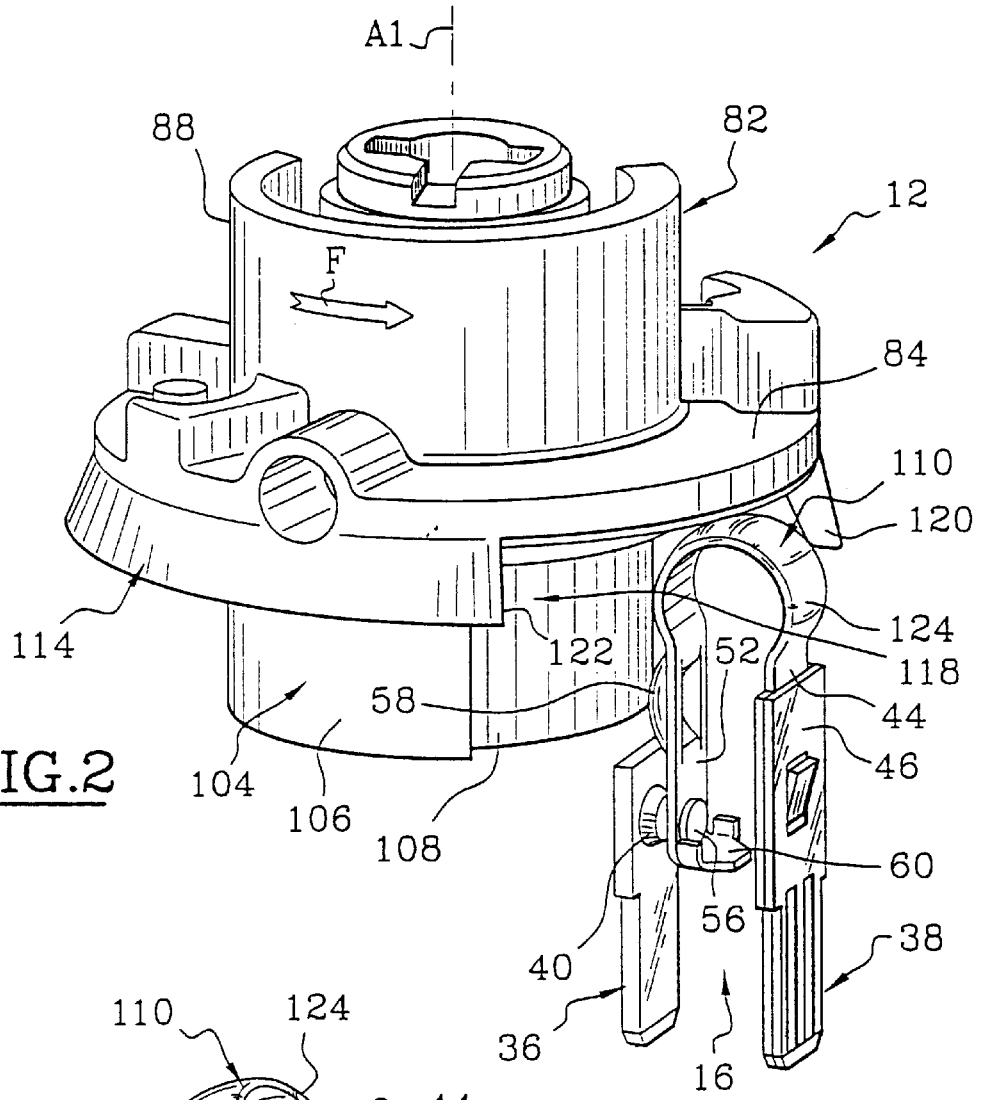
FIG. 2 is a perspective view of the body of the switch rotor that is illustrated in association with the two components of a strip contact supported by the body of the stator.
Figure 4:
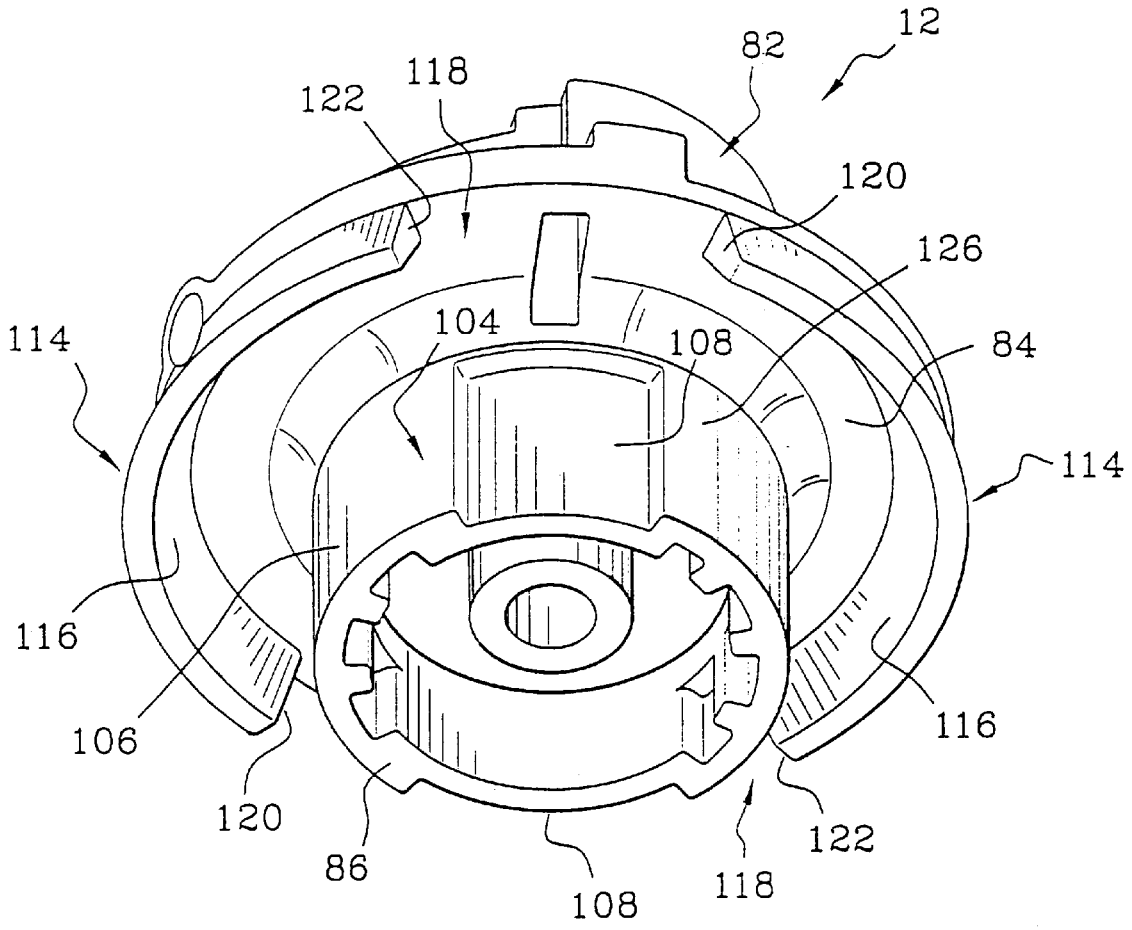
FIG. 4 is a perspective bottom view of the body of the switch rotor according to the invention.

As can be seen particularly in FIGS. 2 and 4, the skirt 114 is not continuous, in other words in this case it is interrupted by two radially oriented through recesses 118, each of which is delimited by two transverse axially aligned surfaces 120 and 122. As can be seen particularly in FIGS. 2 and 4, the angular positions of recesses or hollowed parts 118 are such that they face the recesses 108 of the surface 104 controlling the electrical contacts 16.

In this case, the internal profile forming the surface of the cleaning cam 116 of the skirt 114 is a trapezoidal shape of revolution that is designed to cooperate with the radially external part facing 124 the intermediate connecting segments 110 of the contact strips 44, as will be explained below.

In order to avoid damage to the surface of cam 116, and particularly to avoid the formation of swarf, the side edges of part 124 are beveled and/or have a rounded "non-aggressive" profile. The part 124 may also be locally thinned.

We will now describe the operation of the improvement according to the invention that can result in self-cleaning of the contacts 16 with reference to FIGS. 5 to 8, on which one of the contacts 16 according to the invention is illustrated as an example.

Figures 5, 6, 7, 8:
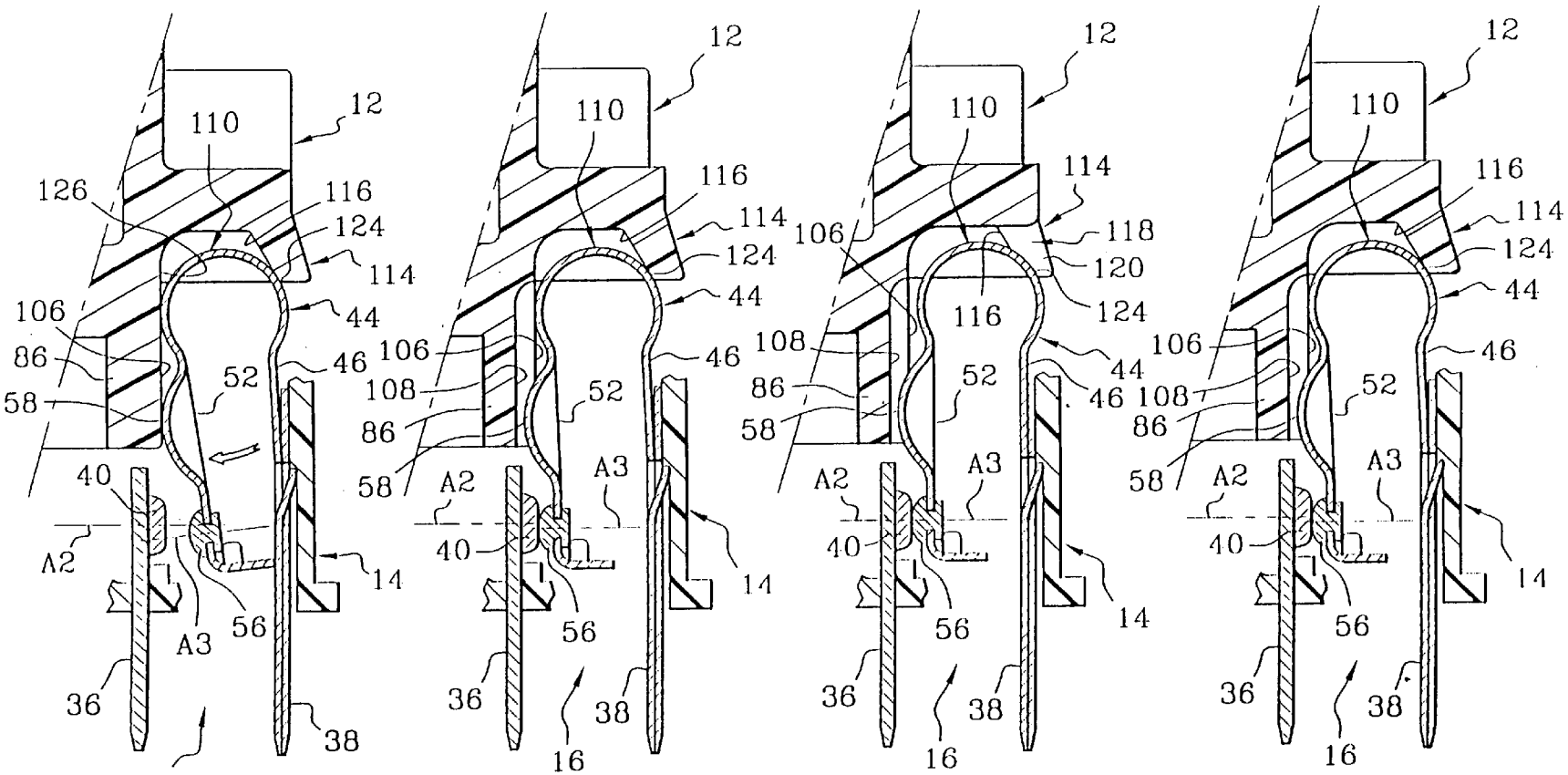
FIG. 5 is a simplified partial view of the lower part of FIG. 1 illustrating a relative position of the different components when the rotor is in its angular position in which an electrical contact is open.
FIG. 6 is a similar view to the view in FIG. 5 in which the rotor is in the next angular position corresponding to the final part of the angular movement of the rotor causing closure of the electrical contact and cleaning of the contact.
FIG. 7 is a view similar to the view in FIG. 6 in which the rotor is in the next angular position in which the electrical contact is closed and cleaned.
FIG. 8 is a view similar to the view in FIG. 7 in which the rotor is in the next angular position corresponding to the initial part of the angular movement of the rotor causing opening of the electrical contact and cleaning of the contact.

In the angular position illustrated in FIG. 5, the electrical contact 16 is illustrated in its open position or state, in other words the contactor 56 supported by the contact strip 44 is not in contact with the fixed contactor 40 supported on pin 36 of stator 14.

Consequently, the convex part 58 of the mobile segment or part 52 of the contact strip 44 cooperates with the cylindrical control surface 106 of the lower tubular part 86 of rotor 12.

The layout of the contact strip 44 and the skirt 114 is such that the upper loop-shaped intermediate part 110 of strip 44 is transversely compressed in an axial plane between the cylindrical surface 126 of the upper part of the tubular segment 86 and the tapered internal surface forming a cam 116 of the skirt 114.

In order to close the contact 16 starting from the position illustrated in FIG. 5, the rotor 12 is rotated with respect to stator 14, for example in the direction shown by the arrow F in la FIG. 2, until the convex control surface 58 is facing a recess 108 in the tubular extension 86.

As can be seen in FIG. 6, as soon as the convex part 58 of the mobile segment 52 of the contact strip 44 penetrates into a recess 108, the mobile contactor 56 moves radially inwards in the direction of the axis A1 to come into contact with the fixed contactor 40 to close the contact 16, by making an electrical connection between pins 36 and 38.

The contact position of the mobile contactor 56 depends on its moving radially inwards to come into contact with the fixed contactor 40.

In the position illustrated in FIG. 6 corresponding to the final phase of the angular movement causing closure of the electrical contact 16, it is found that the surface of the cleaning cam 116 is still cooperating with the portion 124 facing the intermediate connecting segment 110 of the contact strip 44, so as to apply a slight pressure on the upper part of the contact strip 44 in a direction tending to bring the fixed segment 46 and the mobile segment 52 towards each other.

The corresponding angular segment of skirt 114 extends angularly slightly beyond the facing part of the cylindrical surface 106 such that the upper part 110 of the contact strip 44 is not released until slightly after the electrical contact 16 is closed.

This released state is illustrated on FIG. 7, in which it can be seen that the convex control part 58 is still facing a recess 108 whereas the upper part of the contact strip 44 formed by the intermediate curved connecting segment 110 is no longer facing a segment of the skirt 114, but is facing a recess 118, in other words it is no longer confined radially and the contact strip 44 thus occupies its rest position illustrated in FIG. 7.

By comparing FIGS. 6 and 7, it can be seen that releasing the upper part of the contact strip 44 caused a relative vertical displacement of the mobile contactor 56 with respect to the fixed contactor 40, in other words the horizontal axes A2 and A3 of the fixed contactor 40 and the mobile contactor 56 that were vertically offset with respect to each other compared with the position illustrated in FIG. 6, are aligned as can be seen in FIG. 7.

The relative displacement of axes A2 and A3, and therefore the fixed contactor 40 and the mobile contactor 56, takes place while these two contactors remain in contact with each other due to the inherent elasticity of the contact strip 44.

Thus, according to the invention, friction occurs between the contact surfaces of the fixed contactor 40 and the mobile contactor 56 leading to a self-cleaning effect of these two surfaces in contact, thus removing all traces of impurity, dirt or oxide layers that could form on them during use.

Starting from the closed position of the electrical contact 16 illustrated in la FIG. 7, and in order to turn to an open position of this contact, it would for example be possible to rotate the rotor 16 in the direction opposite to the direction described previously with respect to stator 14.

During the initial part of this angular movement in order to open the electrical contact 16, and due to the angular extension of the active sector of skirt 114 on which the surface of cam 116 is formed above the cylindrical control surface 106, there is firstly an action by the surface of the cleaning cam 116 on the part 124 facing the intermediate connecting part 110 to once again compress the upper part of the contact strip 44 and cause another relative vertical displacement of the mobile contactor 56 with respect to the fixed contactor 40, in this case vertically downwards as can be seen on FIG. 8 on which it can be seen that the axis A3 of the mobile contact 56 is once again offset vertically downwards from the axis A2 of the contactor 40.

The angular movement of rotor 12 in order to open contact 16 then continues until the various components are once again in the state illustrated in FIG. 5.

As a variant, the contact 16 may also be opened by rotating rotor 12 with respect to stator 14 in the direction indicated by arrow F, the other active sector of the skirt 114 being delimited by the facet 122 that then cooperates with the upper loop 110 of the contact strip 44 firstly to cause a self-cleaning effect before the cylindrical surface 106 once again cooperates with the convex part 58 of the mobile segment 52 of the contact strip 44 in order to open the electrical contact 16.

What is claimed is:

1. A rotary electrical switch comprising an upper rotor mounted free to rotate about an axis of rotation with respect to a lower stator, the rotor being rotatable between first and second angular positions, the second angular position being connectable to a power supply by at least one electrical strip contact having a fixed axially aligned contact element supported by the stator and a hairpin shaped contact strip that lies within an axial plane and that comprises a fixed axially aligned segment supported by the stator and a mobile axially aligned segment that is generally parallel to the first fixed segment and that is connected to the first fixed segment through an upper intermediate segment in the shape of the arc of a circle, the mobile segment having a free end that is capable of cooperating or not cooperating with a portion facing a contact of the fixed contact element depending on the relative angular position of the rotor and the stator, wherein the rotor includes a cam surface to clean the contact by cooperating with a radially external portion facing the intermediate segment of the contact strip to elastically deform the contact strip globally in a median axial plane, causing relative displacement of the free end of the mobile segment with respect to the contact portion of the fixed contact element with which the mobile segment is in contact, when the rotor closes or opens the contact.

2. An electrical switch according to claim 1, wherein the cam surface is formed inside a cylindrical annular skirt having an axial alignment that is the same as that of the rotor that cooperates with the radially external portion of the intermediate segment of the mobile contact strip facing it, in order to cause relative vertical displacement of the free end of the mobile segment with respect to the contact of the fixed contact element.

3. A switch according to claim 2, wherein the cam surface comprises an active angular sector of revolution that cooperates with the intermediate segment of the contact strip when the contact is open.

4. A switch according to claim 3, wherein the active sector of the cam surface extends angularly so as to cooperate with the intermediate segment of the contact strip during a final part of the angular movement of the rotor that closes the contact, or during an initial part of the angular travel of the rotor that opens the contact.

5. A switch according to claim 3, wherein the active sector of the cam surface has a tapered profile.

6. A switch according to claim 3, wherein the angular active sector of the cam surface is delimited by two recesses formed in the skirt of the rotor.

7. A switch according to claim 2, wherein the mobile segment of the contact strip comprises a control surface on which the rotor can act to elastically push the mobile segment of the contact strip radially outwards to open the contact which is of a normally closed type, resisting inherent elasticity of the contact strip.

8. A switch according to claim 7, wherein the control surface is convex and faces radially inwards, and cooperates with a control surface of the rotor.

9. A switch according to claim 1, wherein the intermediate segment of the contact strip that cooperates with the cam surface has a profile that is non-aggressive to the cam surface.

* * * * *